US005799510A

United States Patent [19]

Mostello

[11] Patent Number: 5,799,510

[45] Date of Patent: Sep. 1, 1998

[54] MULTI-COLUMN SYSTEM AND METHOD FOR PRODUCING PRESSURIZED LIQUID PRODUCT

[75] Inventor: Robert A. Mostello, Somerville, N.J.

[73] Assignee: The BOC Group, Inc., New Providence, N.J.

[21] Appl. No.: 902,887

[22] Filed: Jul. 30, 1997

[51] Int. Cl.[6] ..... F25J 1/00

[52] U.S. Cl. ..... 62/653; 62/910

[58] Field of Search ..... 62/653, 654, 910

[56] References Cited

U.S. PATENT DOCUMENTS

| | | | |
|---|---|---|---|
| 3,236,059 | 2/1966 | Berstein | 62/910 |
| 4,091,633 | 5/1978 | Linde | 62/910 |
| 4,325,719 | 4/1982 | Yamazaki | 62/910 |

*Primary Examiner*—Ronald C. Capossela

*Attorney, Agent, or Firm*—David M. Rosenblum; Salvatore P. Pace

[57] ABSTRACT

An apparatus and method involving the use of a multi-column system in which higher and lower pressure columns are operatively associated with one another by a condenser-reboiler. A pump is provided for pumping a stream of sump liquid of the lower pressure column to produce a pressurized product. The condenser-reboiler is a falling film type of heat exchanger in which liquid is vaporized to produce boilup in the lower pressure column against vaporizing tower overhead in the higher pressure column to reflux both of the columns. Liquid is recirculated back to the condenser-reboiler by an ejector that uses part of a pumped stream as the motive fluid to draw liquid for recirculation. In such manner, less energy is consumed in the recirculation than had all of the recirculated liquid been pumped. Furthermore, an ejector, unlike a second pump used for recirculation purposes, is a solid state device with no moving parts.

5 Claims, 1 Drawing Sheet

MULTI-COLUMN SYSTEM AND METHOD FOR PRODUCING PRESSURIZED LIQUID PRODUCT

BACKGROUND OF THE INVENTION

The present invention relates to a multi-column system and method having higher and lower pressure columns operatively associated with one another by a condenser-reboiler of the downflow type. More particularly the present invention relates to such a system and method in which liquid to be reboiled in the condenser-reboiler is recirculated by an ejector. Even more particularly, the present invention relates such a system and method in which product is pressurized by the pumping the liquid.

In air separation, multiple distillation columns are used to separate the mixture into its components. Advantageously, the columns are thermodynamically associated with one another by a condenser-reboiler that is used to create boil up and reflux in the columns.

An example of a multi-column system is the dual column Linde cycle for the separation of air into nitrogen and oxygen. This type of multi-column system includes a higher pressure column to produce an oxygen enriched column bottoms and a nitrogen enriched tower overhead. The oxygen enriched liquid column bottoms, known in the art as crude liquid oxygen, is further refined in a lower pressure column to produce a liquid oxygen column bottoms. In order to generate boil-up in the lower pressure column and also to generate reflux for both the lower and higher pressure columns, a condenser-reboiler is situated in a bottom sump region of the lower pressure column to condense the nitrogen rich tower overhead from the higher pressure column against vaporizing the oxygen descending within the lower pressure column. As known in the art, an argon column can be associated with the lower pressure column to concentrate argon as a tower overhead. A liquid oxygen product can be withdrawn from the lower pressure column and then pressurized by the use of a pump. The resultant pumped stream can then be vaporized to produce a high pressure product.

Falling film heat exchangers have been employed as condenser-reboilers of air separation plants. Such devices, also known as downflow reboilers, employ a core made up of a plurality of parallel plates. Heat exchange passages are defined between the plates for the nitrogen rich vapor to condense against vaporizing the oxygen rich liquid. In case of air separation, but also other types of distillation, the low pressure column is operated so that all of the liquid fed to the condenser-reboiler will not be vaporized. One reason for this is to prevent the possibility of dryout within the heat exchange passages of the condenser-reboiler used in vaporizing the liquid. In air separation, this can lead to heavier components present within the air, such as flammable hydrocarbons, to concentrate within such heat exchange passages.

In order to prevent the undesirable concentration of heavy components, liquid is recirculated back to the top of the boiling passages. In case of a plant designed to deliver a pressurized product stream by pumping, part of the pumped stream can be expanded to the lower pressure column pressure for recirculation. This is not advantageous in that pumping energy consumed for high pressure is being expended in the recirculation of the liquid which has a lower pressure requirement. Another possibility is to use two pumps. However, the addition of a separate pump adds complexity and capital cost.

As will be discussed, the present invention provides a recirculation method for a downflow heat exchanger serving as a condenser-reboiler that operates in a more energy efficient manner than utilization of a single pump or the disadvantages associated with operating a separate pump for such purpose.

SUMMARY OF THE INVENTION

The present invention provides a multi-column system comprising at least higher and lower pressure columns operatively associated with one another by a condenser-reboiler. The condenser-reboiler condenses tower overhead in the higher pressure column against vaporizing a portion of the liquid descending within the lower pressure column. The condenser-reboiler comprises a falling film type of heat exchanger. A liquid collector is provided within the lower pressure column to collect the liquid for transfer to the condenser-reboiler. A sump is provided to collect the remaining portion of the liquid not vaporized. A first branched flow circuit is connected to the sump and has first and second branches. A pump is connected to the first branch of the branched flow circuit to pressurize the stream of the remaining portion of the liquid. A second branched flow circuit is connected to the pump and as an outlet branch in a return branch. An ejector having a high pressure inlet is connected to the return branch. A low pressure inlet of the ejector is connected to the second branch. A conduit communicates between an outlet of the ejector and the liquid collector.

In another aspect, the present invention provides a method of producing a pressurized liquid product from a distillation column system having at least higher and lower pressure columns. The columns are operatively associated with one another by a condenser-reboiler of the falling film type to condense tower overhead in the higher pressure column against vaporizing a portion of liquid descending within the lower pressure column. In accordance with the method, the liquid is collected and transferred to the condenser-reboiler. The portion of the liquid is vaporized within the condenser-reboiler. A first stream of a remaining portion of the liquid not vaporized is pumped and then divided into two subsidiary streams. A second stream of the remaining portion of the liquid is drawn into a mixture with one of the two subsidiary streams by introducing the one of the two subsidiary streams into an ejector and drawing the second stream at a low static pressure produced by the one of the two subsidiary streams in the ejector. A mixed stream composed of the mixture is recirculated back to the condenser-reboiler and the other of the two subsidiary streams is taken as the pressurized liquid product.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which the sole figure is a schematic view of an apparatus for carrying out a method in accordance with the present invention.

DETAILED DESCRIPTION

Figure 1:
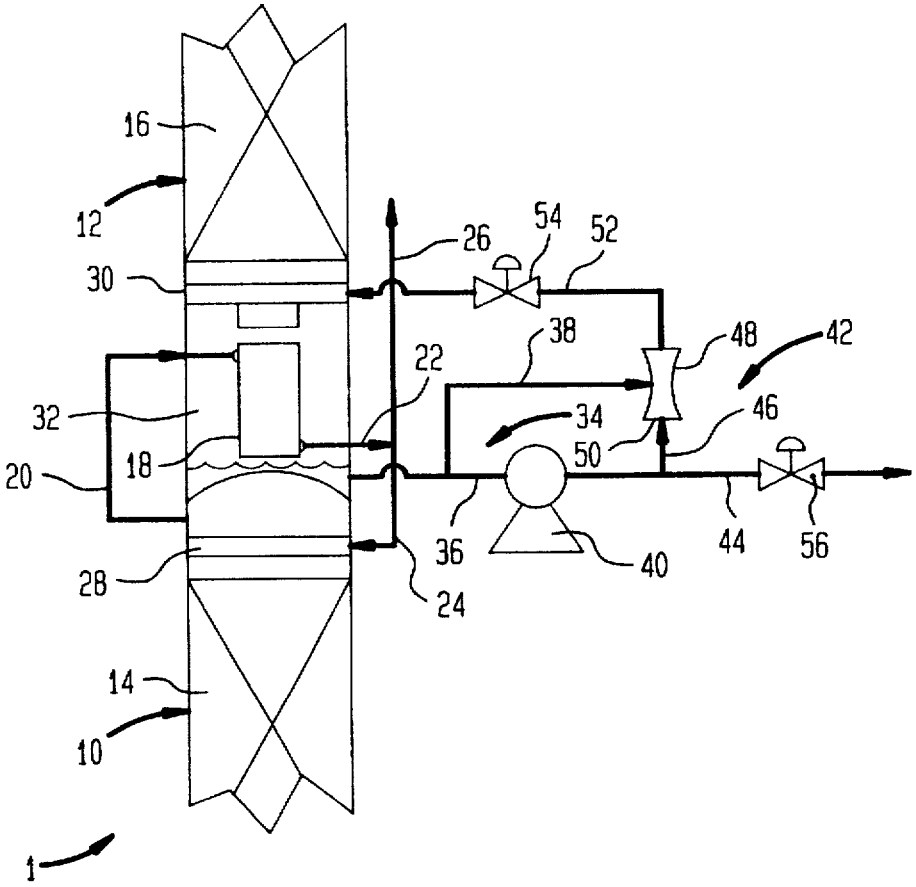

With reference to the figure, a multi-column system 1 is illustrated having a higher pressure column 10 and a lower pressure column 12. It is understood that the present invention is not limited by the number of columns employed. In case of an air separation plant, it would have equal applicability to a three column system having high, medium and low pressure columns within a single column shell or a double Linde column arrangement with or without an argon side arm column.

In either of the higher or lower pressure columns, distillation is effectuated by contacting an ascending vapor phase against a descending liquid phase within mass transfer elements 14 and 16 formed by distillation trays or packing elements (either structured or random.) The higher and lower pressure columns are operatively associated with one another by a condenser-reboiler 18. Condenser-reboiler 18 is a falling film type of heat exchanger that is formed of parallel plates that define parallel passages to bring fluids into an indirect heat exchange relationship.

In multi-column system 1, tower overhead produced in higher pressure column 10 is removed as a stream 20 and condensed within condenser-reboiler 18 to produce a reflux stream 22 which is divided into first and second parts 24 and 26. Part 24 of reflux stream 22 is conducted to a liquid distributor 28 and higher pressure column 10. The liquid serves as reflux in higher pressure column 10. Although not illustrated, but as would be known, part 26 of reflux stream 22 would serve as reflux in lower pressure column 12. The condensation of tower overhead is effectuated against boiling descending liquid within lower pressure column 12 which is caught by a liquid distributor 30. Liquid distributor 30 distributes the liquid descending to condenser-reboiler 18. Part of the liquid vaporizes within condenser-reboiler 18. The liquid that is not vaporized collects as sump liquid 32 within the bottom sump portion of lower pressure column 12. As understood by those skilled in the art, condenser-reboiler could be housed in a tank that would function in the same manner as the sump of lower pressure column 12.

As has been discussed, not all of the liquid that is distributed to condenser-reboiler 18 is in fact vaporized. To this end a first branched flow circuit 34 is provided. First branched flow circuit 34 has first and second branches 36 and 38 and is connected to the sump or lower portion of lower pressure column 12. A pump 40 is connected to first branch 36 of branched flow circuit 34 to pressurize a stream of a remaining portion of the liquid. A second branched flow circuit 42 is connected to the pump and is provided with an outlet branch 44 and a return branch 46. A high pressure inlet of ejector 48 is connected to return branch 46 to receive pressurized liquid. Such pressurized liquid pass through an orifice or other constriction within ejector 48 to produce a low static pressure within the liquid by a venturi effect. The low static pressure draws liquid from second branch 38 through a low pressure inlet of ejector 48. The outlet of ejector 48 is connected by a conduit 52 to liquid distributor 30 to distribute the liquid back to condenser-reboiler 18. Valves 54 and 56 can be provided in order to adjust flow conditions to account for actual performance of ejector 48.

As can be appreciated, since not all of the liquid is pumped at a high pressure, there is an energy savings associated with the arrangement of the present invention when compared to prior art arrangements that use a single pump. Additionally, an ejector is a device with no moving parts. Hence, the present invention has advantages over a two pump arrangement.

By way of calculated example, if lower pressure column 12 operates at a liquid to vapor ratio of about 1.4 and a 70 molar unit downflow of liquid is assumed for lower pressure column 12, 50 molar units of vapor will be required to be vaporized within condenser-reboiler 18 and at a 1 to 1 ratio of vapor to remaining liquid, a stream of 50 molar units is withdrawn through first branch 34. If lower pressure column is assumed to operate at 1.5 bar(g), a 10 bar(g) product is to be produced, and ejector 48 operates at an efficiency of about 10% and a 1 bar increase in pressure is required to return liquid to collector 30, the flows within first and second branched flow paths 34 and 42 can be readily calculated through linear algebra. These calculations show flows of about 12.9 molar units through second branch 38 and 37.1 molar units through first branch 36. This allows about 20 molar units to be produced as the ten bar product while recirculating about 30 molar units back to condenser-reboiler 18. This is to be compared with prior art devices in which the 30 units are recirculated after having been pressurized or separately pumped.

While the present invention has been discussed with reference to a preferred embodiment, as will occur to those skilled in the art, numerous changes, additions and omissions may be made without departing from the spirit and scope of the present invention.

I claim:

1. A multi-column system comprising:

at least higher and lower pressure columns operatively associated with one another by a condenser-reboiler to condense tower overhead in the higher pressure column against vaporizing a portion of liquid descending within the lower pressure column, the condenser-reboiler comprising a falling film type of heat exchanger;

a liquid collector to collect said liquid for transfer to said condenser-reboiler;

a sump to collect a remaining portion of the liquid not vaporized;

a first branched flow circuit connected to said sump and having first and second branches;

a pump connected to the first branch of the branched flow circuit to pressurize a stream of the remaining portion of the liquid;

a second branched flow circuit connect to said pump and having an outlet branch and a return branch;

an ejector having a high pressure inlet connected to said return branch, a low pressure inlet connected to said second branch, and an outlet; and a conduct communicating between said high pressure outlet and said liquid collector.

2. The double column system of claim 1, wherein said higher and lower pressure columns are configured such that said liquid collected in said sump is a liquid oxygen product.

3. The double column system of claim 1, wherein said sump is located within said lower pressure column.

4. A method of producing a pressurized liquid product from a multi-column system having at least higher and lower pressure columns operatively associated with one another by a condenser-reboiler of the falling film type to condense tower overhead in the higher pressure column against vaporizing a portion of liquid descending within the lower pressure column, said method comprising:

collecting and transferring said liquid to said condenser-reboiler;

vaporizing the portion of the liquid within the condenser reboiler;

pumping a first stream of a remaining portion of the liquid not vaporized;

dividing said first stream into two subsidiary streams;

drawing a second stream of the remaining portion of the liquid into a mixture with one of the two subsidiary streams by introducing said one of the two subsidiary streams into an ejector and drawing said second stream at a low static pressure produced by said one of the two subsidiary streams in said ejector;

recirculating a mixed stream composed of said mixture back to said condenser-reboiler; and taking the other of said two subsidiary streams as said pressurized liquid product.

5. The method of claim 1, wherein said pressurized liquid product comprises oxygen.

* * * * *